US007442279B2

(12) United States Patent
Hermans et al.

(10) Patent No.: US 7,442,279 B2
(45) Date of Patent: Oct. 28, 2008

(54) METHOD AND APPARATUS FOR PRODUCING TISSUE PAPER

(75) Inventors: Michael A. Hermans, Neenah, WI (US); Kenneth J. Zwick, Neenah, WI (US); Peter J. Allen, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 383 days.

(21) Appl. No.: 11/267,689

(22) Filed: Nov. 4, 2005

(65) Prior Publication Data

US 2007/0102127 A1 May 10, 2007

(51) Int. Cl.
*B28B 21/48* (2006.01)

(52) U.S. Cl. ..... 162/118; 162/283; 162/207; 162/109; 34/114

(58) Field of Classification Search ..... 162/207, 162/118, 283, 109; 34/114, 444
See application file for complete search history.

(56) References Cited

U.S. PATENT DOCUMENTS

| | | | | |
|---|---|---|---|---|
| 5,169,412 | A | 12/1992 | Prasad et al. | |
| 5,593,545 | A | 1/1997 | Rugowski et al. | |
| 5,607,551 | A | 3/1997 | Farrington, Jr. et al. | |
| 5,672,248 | A | 9/1997 | Wendt et al. | |
| 6,461,476 | B1 | 10/2002 | Goulet et al. | |
| 6,743,334 | B2 * | 6/2004 | Klerelid et al. | 162/118 |
| 6,869,506 | B2 * | 3/2005 | Jewitt | 162/207 |
| 6,910,283 | B1 | 6/2005 | Reddy | |
| 7,112,258 | B2 * | 9/2006 | Klerelid et al. | 162/109 |

* cited by examiner

*Primary Examiner*—Mark Halpern
(74) *Attorney, Agent, or Firm*—Gregory E. Croft

(57) ABSTRACT

A method of making paper comprising over drying the paper web by a dryer; transporting the paper web to a reel; and supplying dry air adjacent at least a portion of the paper web's travel path from the dryer to the reel. A paper machine comprising a dryer and a reel; at least one blow box located between the dryer and the reel; and a blower supplying a source of dry air to the at least one blow box.

18 Claims, 3 Drawing Sheets

METHOD AND APPARATUS FOR PRODUCING TISSUE PAPER

BACKGROUND

In the manufacture of tissue paper there is on ongoing desire to produce tissue paper having high levels of softness and high levels of bulk (inverse of density). By producing a soft tissue paper, consumer demand for the tissue is enhanced. By producing a bulky tissue paper, profitability for the papermaker is enhanced.

While many processes for making tissue paper exist, a through-air dried process is one that can enhance both the bulk and softness of the tissue paper. Premium quality tissue paper is often produced using a through-air drying process. Thus, there is a need for an improved through-air dried tissue process to produce tissue paper having improved bulk and/or softness.

SUMMARY

The inventors have determined that the above needs can be met by a method and apparatus that over dries the tissue paper to a moisture level below its moisture equilibrium point (approximately 5-6 percent moisture) and then prevents the tissue paper from reaching its moisture equilibrium point until after it has been wound into a parent roll. Such a method can be implemented, for example, by supplying dry air adjacent at least a portion of the tissue paper's travel path between the through-air dryer and the reel.

In other embodiments, the tissue paper can be prevented from reaching its moisture equilibrium point until after it has been unwound. Such a method can be implemented, for example, by supplying dry air adjacent at least a portion of the tissue paper's travel path between the through-air dryer and the reel and then wrapping the parent roll after being wound while stored in a moisture impermeable substrate such as a film or a plastic bag. The parent roll can be stored in the bag, even for relatively short periods of time, such as less than about one hour, until placed into an unwind of a converting line. In other cases, the parent roll can be stored in this manner for a longer period of time, such as seven or more days.

Hence, in one aspect, the invention resides in a method of making paper including: over drying the paper web by a dryer; transporting the paper web to a reel; and supplying dry air adjacent at least a portion of the paper web's travel path from the dryer to the reel.

In another aspect, the invention resides in a paper machine including: a dryer and a reel; at least one blow box located between the dryer and the reel; and a blower supplying a source of dry air to the at least one blow box.

BRIEF DESCRIPTION OF THE DRAWINGS

The above aspects and other features, aspects, and advantages of the present invention will become better understood with regard to the following description, appended claims, and accompanying drawings where:

Figure 1:
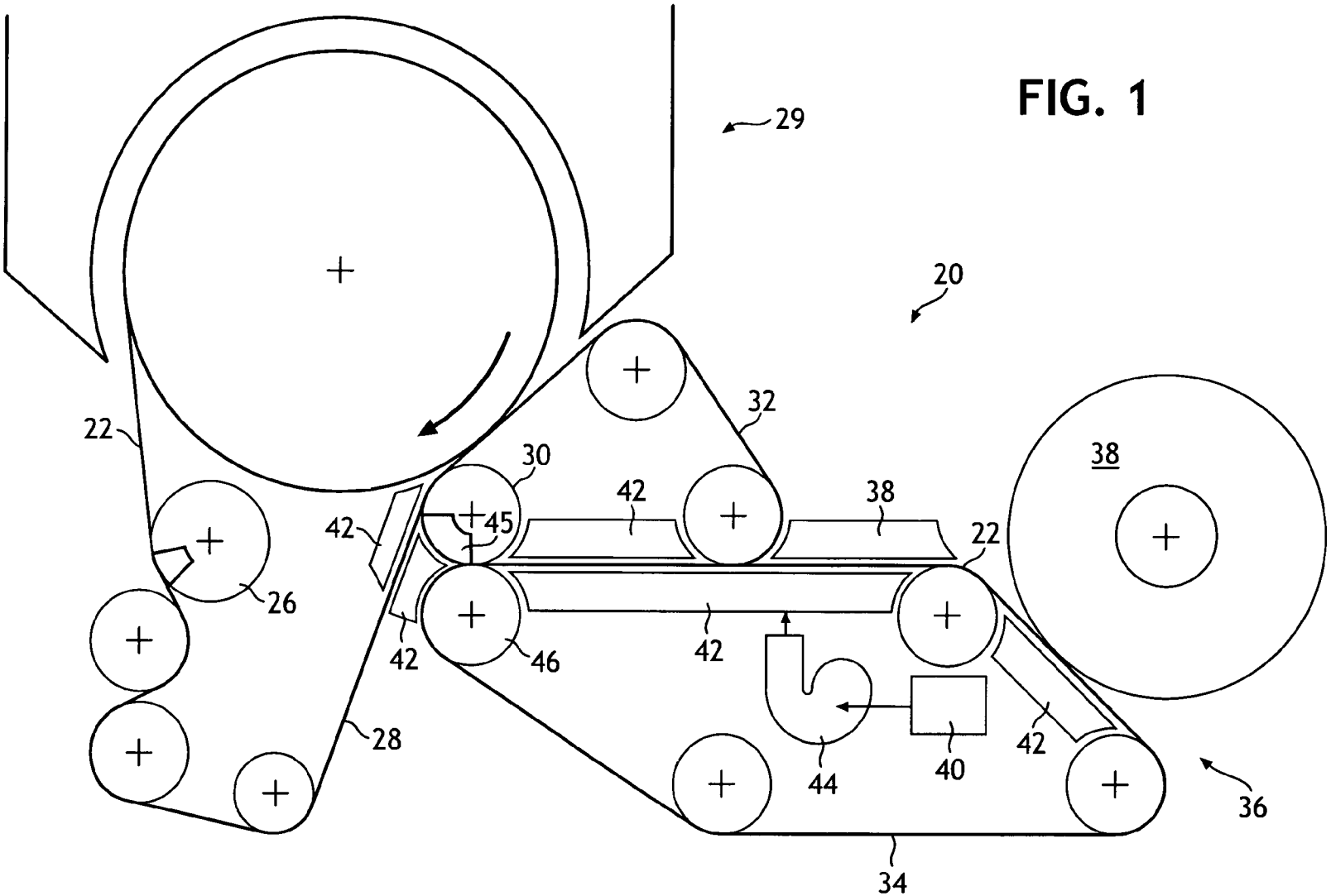
FIG. 1 illustrates a dry end of a paper machine.

Repeated use of reference characters in the specification and drawings is intended to represent the same or analogous features or elements of the invention.

DEFINITIONS

As used herein, "dry air" is air that has had its relative humidity reduced below that of the room air near the paper machine by use of any method such as a desiccant, refrigerative, or membrane air dryer. While the relative humidity of the ambient air can vary in the manufacturing facility where the paper machine is located, it is not unusual for the relative humidity of the room air near the paper machine to be approximately 40 percent or greater. In various embodiments of the invention, the dry air can have a relative humidity of about 20 percent or less, about 15 percent or less, or about 10 percent or less.

As used herein, "over dried or over drying" refers to a tissue web, tissue paper, or paper that has been dried to a moisture content below its equilibrium moisture content in ambient air. While the equilibrium moisture content can vary depending on the relative humidity and temperature, for tissue paper the moisture equilibrium content is approximately 5-6 percent moisture.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Figure 2:
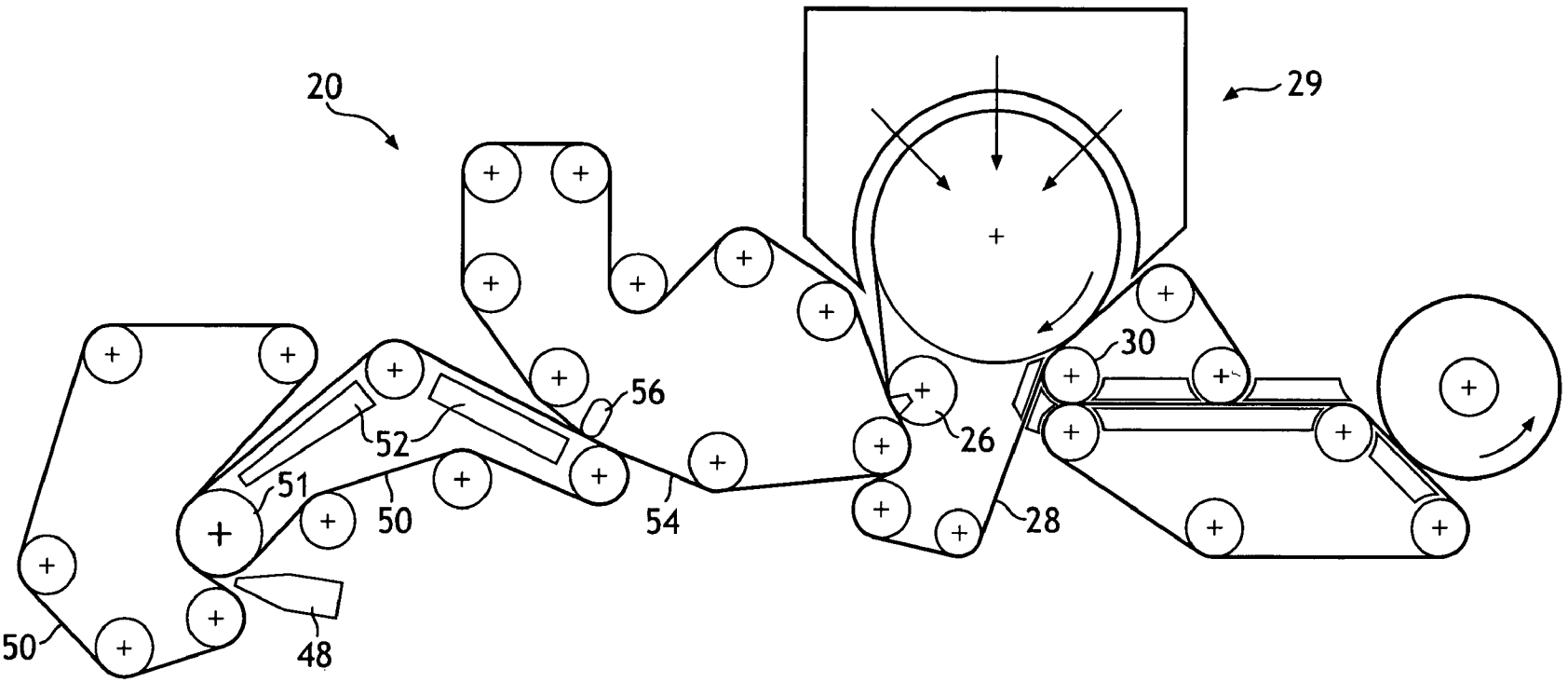
FIG. 2 illustrates a paper machine.

FIGS. 1 and 2 illustrate a through-air dried tissue paper process. In particular, the process illustrated is an uncreped through-air dried process (UCTAD). Other UCTAD processes are disclosed in U.S. Pat. No. 5,607,551, issued Mar. 4, 1997 to Farrington et al., U.S. Pat. No. 5,672,248, issued Sep. 30, 1997 to Wendt et al., and U.S. Pat. No. 5,593,545, issued Jan. 14, 1997 to Rugowski et al., all herein incorporated by reference.

By studying the UCTAD process, the inventors have discovered that softer and/or bulkier tissue can be made by over drying the tissue paper to a condition less than its equilibrium moisture content at the point that the tissue web exits the through-air dryer (TAD). In general, the tissue paper can be over dried to a moisture content of about 5 percent or less, about 4 percent or less, about 3 percent or less, about 2 percent or less, about 1 percent or less, or about 0.5 percent or less at the point that the tissue web exits the TAD.

The inventors have determined that as the moisture content is reduced, the bulk and/or softness of the converted tissue paper is enhanced. More specifically, the inventors have determined that for a tissue paper that is produced to a final caliper and tensile specification, the bulk and/or softness of the final product is enhanced after converting. It is believed that the bulk and/or softness are enhanced because the tissue paper suffers less caliper loss in the parent roll if over dried and also yields greater softness for a given caliper during calendaring if over dried.

The inventors have also determined that if the moisture content of the tissue paper becomes too great, the winding parent roll at the reel can slip as it is being wound into a large diameter roll exceeding approximately 100 inches in diameter. The higher moisture content tissue paper can lead to an entire parent roll being scrapped due to defects while winding with roll slippage.

Lastly, the inventors have also determined that the pressure profile of the parent roll (with significantly higher pressures near the core compared to the outside of the roll) leads to a caliper profile in the parent roll with significantly lower calipers near the core compared to the outside due to compressive creep of the tissue paper. The creep rate increases with moisture content, leading to larger differences in the caliper throughout the parent roll as the moisture content increases. It is possible for the tissue paper near the core to lose too much caliper that it can no longer form a firm wound roll or bulky folded stack when converted. The tissue paper near the core often must be scrapped as a result. The amount of tissue paper that must be scrapped near the core increases with the increase in the moisture content of the tissue paper produced by the tissue machine.

Through further studies, the inventors have determined that one grade of UCTAD tissue paper when over dried to a moisture content of approximately 1 percent and then placed into various environmental relative humidities from about 10 percent to about 80 percent had a time constant of approximately 8.8 minutes in still air. Thus, the UCTAD tissue paper can absorb approximately 64 percent of its final moisture content in about 8.8 minutes.

Additional studies have shown that increasing the moisture content of the tissue paper from about 1 percent to about 3 percent at the TAD exit causes:

- An approximate 2 percent decrease in tissue caliper believed to be the result of a loss in the permanent molding imparted to the paper web from the TAD fabric while being dried.
- An approximate 2 percent decrease in tissue caliper believed to be the result of the Z-direction compressive forces acting on the tissue paper as it traverses the winding nip while being wound into a parent roll at the reel.
- An approximate 3 percent decrease in tissue caliper believed to be the result of the compressive forces acting on the tissue paper while stored as a wound parent roll waiting to be unwound and converted.
- An approximate 10 percent decrease in tissue caliper believed to be the result of calendering of the tissue paper for improved softness at the higher moisture content prior to being wound into a bath tissue roll.

Increasing the moisture content of the tissue paper about 2 percent at the TAD exit leads to an overall caliper reduction of approximately 17 percent in the finished tissue product after converting. A caliper loss of 17 percent is significant, resulting in undesirably wound bath tissue rolls that are mushy having lower roll firmness numbers. As such, the inventors have determined that it is important to over dry the tissue paper to a lower moisture content at the exit of the TAD.

Figure 3:
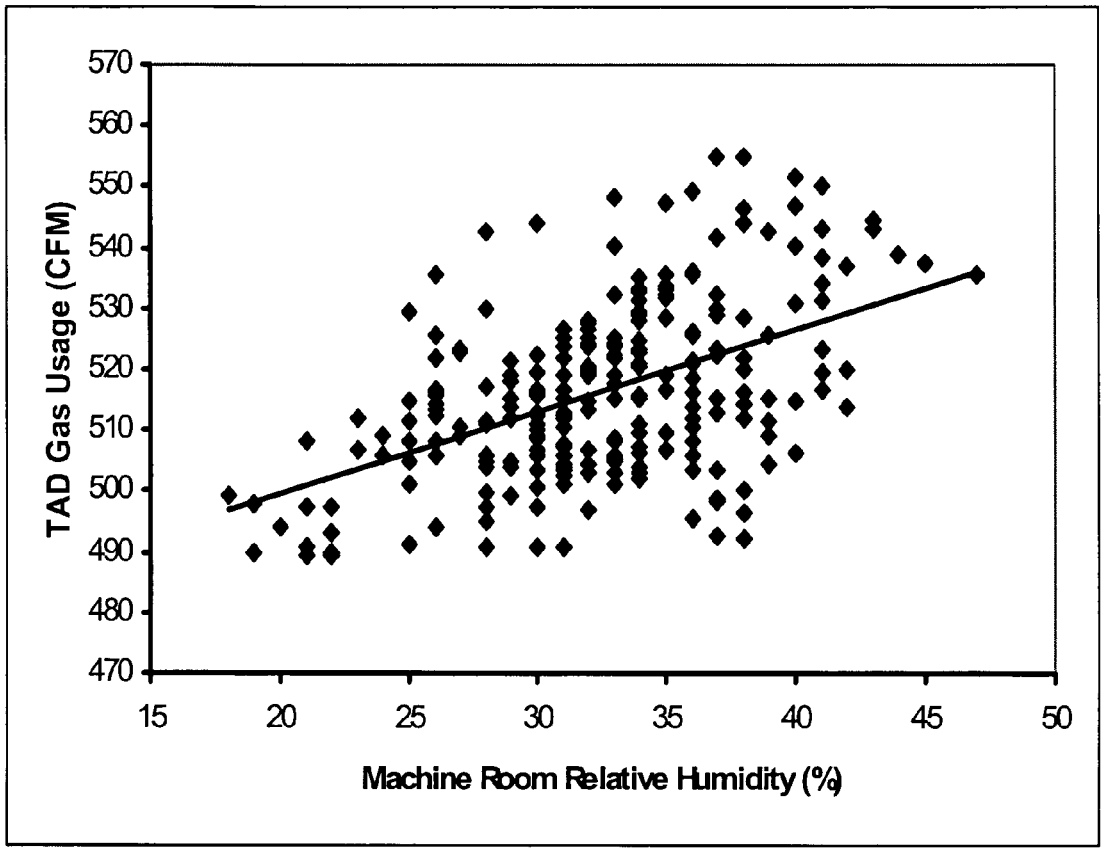
FIG. 3 illustrates a graph of Gas Usage versus Machine Room Relative Humidity.

Furthermore, the inventors have discovered a correlation between the room humidity where the paper machine is located and the energy consumption of the second of two through dryers when running an UCTAD process on a commercial tissue machine similar to that shown in FIG. 2, but with two through dryers. FIG. 3 shows the relationship between TAD Gas Usage and Machine Room Relative Humidity in the second of two through dryers when producing tissue paper at a constant speed and to a constant moisture content as measured just prior to being wound into a parent roll at the reel by a scanner. By observing FIG. 3, higher room humidities generally resulted in greater gas consumption by the second through-air dryer to over dry the tissue paper to the same final moisture content. It is believed this result occurs because increases in paper machine room humidity caused greater re-wet of the tissue paper during the paper making process after leaving the TAD. Thus, the paper making process required a lower moisture content for the paper web exiting the TAD when the room humidity was higher to compensate for the re-wet that was occurring.

However, once the tissue paper is over dried, it readily absorbs moisture from the air in a short period of time as discussed above. The problem is further exacerbated by the air in the paper machine room or the converting room being at higher ambient relative humidity levels. Thus, once the tissue paper has been over dried, it is important to minimize or decrease any increase in its moisture content as it moves through the paper machine, while being stored, and/or while being converted.

Referring to FIG. 1, the dry end of a paper machine 20 of FIG. 2 is shown. A tissue web 22 is transferred to a TAD fabric 28 by a first vacuum transfer roll 26. The tissue web is then over dried by a TAD 29 to a low moisture content such as about 1 percent or less in one embodiment. After exiting the TAD, the tissue web is transferred by a second vacuum transfer roll 30 to a top carrier fabric 32 and then sandwiched between the top carrier fabric and a bottom carrier fabric 34 as it is advanced toward a reel 36. After exiting the fabric sandwich, the tissue web is conveyed to the reel by the bottom carrier fabric and wound into a parent roll 38 against a free span of the bottom carrier fabric. The free span of the bottom carrier fabric forms a soft nip that reduces compression of the paper web as it is wound.

As discussed above, once the over dried tissue paper leaves the TAD it will quickly absorb moisture from the humid paper machine room air. To prevent or minimize the tissue paper's absorption of moisture, the dry end of the paper machine is provided with an air dryer 40 to supply dry air adjacent to at least a portion of the tissue paper's travel path from the exit of the TAD to the reel.

Suitable air dryers 40 for removing water from the air can include desiccant, refrigerative, and membrane air dryers. Desiccant dryers generally contain a material such as a silica-gel or activated alumina that adsorbs water vapor when moist air is brought into contact with the gel. Often, the dryer is composed of two sections, one of which is active, while in the other section the desiccant is being regenerated (dewatered). Refrigerative air dryers work by cooling a gas to within a few degrees of the freezing point of water. The resulting condensed moisture is removed in a separator and drain trap mechanism located downstream of the refrigerant evaporator. Membrane air dryers, as described in U.S. Pat. No. 5,169,412, offer another suitable method for removing water from air. Among the companies manufacturing or distributing the more common dessicant and refrigerative dryers are the following: Sullair, Arrow, Pioneer, Air-Tek, Van Air, Aggreko PLC, Domnick-Hunter, Kaeser and Wilkerson. Any of the above methods, or other methods, for reducing the relative humidity of the room air are suitable for the purposes of this invention.

In particular, one area that is especially prone to rewetting the tissue paper is near the second vacuum transfer roll 30. In order to transfer the tissue paper from the TAD fabric to the top carrier fabric, a vacuum transfer roll is used. However, since the tissue paper is highly permeable, machine room air from the vicinity of the TAD is pulled right through the over dried tissue paper by the vacuum transfer roll. Often the machine room air in the vicinity of the TAD is extremely high in humidity. The TAD process evaporates water from the tissue paper creating humid air that is not fully contained by the TAD. As a result, the tissue paper has moist humid air pulled through it by the second vacuum transfer roll.

To prevent rewetting the tissue paper at this point in the process, one or more blow boxes 42 can be supplied by a blower 44 directing a source of dry air from the air dryer toward the second vacuum transfer roll. In particular, the dry air can be supplied or directed at a vacuum zone 45 on the second vacuum transfer roll. The dry air can displace the moist humid air near the second vacuum transfer roll such that dry air, rather than the humid air, is pulled through the tissue web during the transfer by the vacuum zone. In FIG. 2 only one blow box is shown connected to the blower; however, it is understood that all of the operational or desired blow boxes are connected to the blower. Furthermore, common ducting elements such as dampers can be used to adjust the amount of dry air supplied by each blow box.

The blow boxes can be constructed to seal to the moving fabric, the second vacuum transfer roll, and/or a bottom lead-in roll 46 for the bottom carrier fabric as known to those of skill in the art. Alternatively, the blow boxes can be designed and sized such that only a small gap exists between the blow box and the surface it is placed adjacent to. Alternatively, the blow boxes can be designed with doctor blades, air foils, deflectors, air showers, or other mechanical elements for reducing the boundary layer air that is traveling with the paper web and/or fabric. The boundary layer air can be quite humid since it is being pulled from the TAD exit. Alternatively, the blow boxes can have end caps or plates to reduce the intake and entrainment of humid air from the machine room adjacent the sides of the paper machine. The above construction techniques can be used individually or in various combinations to increase the effectiveness of the blow boxes in displacing the humid air near the tissue web and partially or completely replacing it with the dry air.

After the second vacuum transfer roll, one or more additional blow boxes can be located adjacent either the top carrier fabric, the bottom carrier fabric, and/or the tissue web to displace humid air as the paper web is conveyed to the reel. The blow boxes can supply dry air adjacent to the tissue web's exposed surface or the blow boxes can supply dry air adjacent to either or both carrier fabrics that support or carry the tissue web toward the reel. These blow boxes can have the same or different construction techniques as used for the blow boxes near the second vacuum transfer roll. The blow boxes can be designed such that dry air is captured by the boundary layer of air traveling with the tissue web and/or fabric. By entraining dry air in the boundary layer air, it may be possible to supply less dry air to the blow boxes and/or reduce the number of blow boxes or their length.

Once the paper web reaches the reel, it is wound into a parent roll 38. A blow box near the winding nip can be supplied to further reduce the chances of humid machine room air rewetting the paper web. After winding, the parent roll can be removed from the reel and wrapped in a moisture impermeable substrate such as a film or a plastic bag. Alternatively, the parent roll can be stored in a specially designed holding area having a low relative humidity to prevent rewetting the over dried tissue paper.

Further rewet of the tissue paper can be prevented by controlling the relative humidity of the machine room where the converting equipment is located that converts the parent roll into a final product such as a bath tissue roll. A typical converting line can include an unwind for unwinding the parent roll, a calender for calendering the tissue web, and a winder for winding the calendered tissue web into a plurality of bath tissue rolls. In various embodiments of the invention, the relative humidity of the room air where the converting equipment is located can be about 35 percent or less, about 30 percent or less, or about 25 percent or less.

While the use of supplying dry air adjacent to the paper web to prevent rewet of the over dried tissue paper has been described in conjunction with the UCTAD process, the method can be used with any papermaking process or converting process by placing a source of dry air adjacent the travel path of the paper web after being over dried. For example the process can be used with a wet pressed tissue machine having a Yankee dryer. Similarly, wrapping the wound parent roll with a moisture impermeable substrate can be done to paper rolls produced by other papermaking processes.

Specifically in the converting process, the moisture impermeable substrate can be removed from the parent roll and the tissue paper can be converted into a finished product in a room having a low relative humidity such as less than about 35 percent. The converting process can further include a calender for calendering the paper web to enhance the softness while the tissue paper is over dried and has a low moisture content such as less than about 5, 4, 3, 2, or 1 percent moisture. The calendering process can be performed on the over dried tissue web to reduce the associated caliper loss that can occur at higher moisture levels. Alternatively or in combination with any of the above methods, the moisture impermeable substrate can be removed from the parent roll, the parent roll can be unwound, and a source of dry air can be supplied adjacent at least a portion of the paper web's travel path during converting into a finished product. For example, dry air can be supplied adjacent to the tissue web's travel path leading to a calendering operation while being converted.

Referring now to FIG. 2, one configuration of an UCTAD tissue machine is illustrated. Shown is a paper machine 20 having a twin wire former with a layered papermaking headbox 48 which injects or deposits a stream of an aqueous suspension of papermaking fibers between two forming fabrics 50. The forming fabric adjacent a forming roll 51 supports and carries the newly-formed wet web downstream in the process as the web is partially dewatered. Additional dewatering of the wet web can be carried out by one or more vacuum boxes 52 while the wet web is supported by the forming fabric.

The wet web is then transferred from the forming fabric to a transfer fabric 54 traveling at a slower speed than the forming fabric in order to impart increased MD stretch into the web. The transfer is preferably carried out with the assistance of a vacuum shoe 56 and a fixed gap or space between the forming fabric and the transfer fabric or a kiss transfer to avoid compression of the wet web.

The web is then transferred from the transfer fabric to the TAD fabric 28 with the aid of a first vacuum transfer roll 26 or a vacuum transfer shoe, optionally again using a fixed gap transfer as previously described. The through drying fabric can be traveling at about the same speed or a different speed relative to the transfer fabric. If desired, the through drying fabric can be run at a slower speed to further enhance stretch. Transfer is preferably carried out with vacuum assistance to ensure deformation of the sheet to conform to the through drying fabric, thus yielding desired Bulk and appearance.

While supported by the through drying fabric, the web is final dried to a consistency of about 95 percent or greater at the exit of the TAD. Thereafter the paper web is processed as described in relation to FIG. 1. Although not shown, subsequent calendering in converting can be used to improve the smoothness and softness of the basesheet.

Papermaking fibers useful for making the UCTAD tissue include any cellulosic fibers which are known to be useful for making paper, particularly those fibers useful for making relatively low density papers such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers.

Softening agents, sometimes referred to as debonders, can be used to enhance the softness of the tissue product and such softening agents can be incorporated with the fibers before, during or after dispersing. Such agents can also be sprayed or printed onto the web after formation, while wet or added to the wet end of the tissue machine prior to formation. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanoi amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without, limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 ( di(hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

Rather than a twin wire former, alternative forming processes can be used. Such formation processes include Fourdrinier, roof formers (such as suction breast roll), and gap formers (such as twin wire formers, crescent formers), etc. A twin wire former is preferred for higher speed operation. Forming wires or fabrics can also be conventional, the finer weaves with greater fiber support being preferred to produce a smoother sheet and the coarser weaves providing greater bulk. Headboxes used to deposit the fibers onto the forming fabric can be layered or nonlayered, although layered headboxes are advantageous because the properties of the tissue can be finely tuned by altering the composition of the various layers.

More specifically, for a single-ply product it is preferred to provide a three-layered tissue having dispersed fibers on both the "air side" of the tissue and on the "fabric side" of the tissue. (The "air side" refers to the side of the tissue not in contact with the fabric during drying, while the "fabric side" refers to the opposite side of the tissue which is in contact with the through dryer fabric during drying.) The center of the tissue preferably comprises ordinary softwood fibers or secondary fibers, which have not been dispersed, to impart sufficient strength to the tissue. However, it is within the scope of this invention to include dispersed fibers in all layers. For a two-ply product, it is preferred to provide dispersed fibers on the fabric side of the tissue sheet and ply the two tissue sheets together such that the dispersed fiber layers become the outwardly facing surfaces of the product. Nevertheless, the dispersed fibers (virgin fibers or secondary fibers) can be present in any or all layers depending upon the sheet properties desired. In all cases the presence of dispersed fibers can increase bulk and lower stiffness. The amount of dispersed fibers in any layer can be any amount from 1 to 100 weight percent, more specifically about 20 weight percent or greater, about 50 weight percent or greater, or about 80 weight percent or greater. It is preferred that the dispersed fibers be treated with a debonder, as herein described, to further enhance bulk and lower stiffness.

In manufacturing the UCTAD tissue, it is preferable to include a transfer fabric to improve the smoothness of the sheet and/or impart sufficient stretch. As used herein, "transfer fabric" is a fabric which is positioned between the forming section and the drying section of the web manufacturing process. The fabric can have a relatively smooth surface contour to impart smoothness to the web, yet must have enough texture to grab the web and maintain contact during a rush transfer. It is preferred that the transfer of the web from the forming fabric to the transfer fabric be carried out with a fixed-gap transfer or a kiss transfer in which the web is not substantially compressed between the two fabrics in order to preserve the caliper or bulk of the tissue and/or minimize fabric wear.

Transfer fabrics include single-layer, multi-layer or composite permeable structures. Preferred fabrics have at least one of the following characteristics: (1) On the side of the transfer fabric that is in contact with the wet web (the top side), the number of machine direction (MD) strands per inch (mesh) is from 10 to 200 (4 to 80 per centimeter) and the number of cross-machine direction (CD) strands per inch (count) is also from 10 to 200. The strand diameter is typically smaller than 0.050 inch (1.3 millimeter); and (2) on the top side, the distance between the highest point of the MD knuckle and the highest point of the CD knuckle is from about 0.001 to about 0.02 or 0.03 inch (0.025 to about 0.5 or 0.75 millimeter). In between these two levels, there can be knuckles formed either by MD or CD strands that give the topography a 3-dimensional characteristic. Specific suitable transfer fabrics include, by way of example, those made by Asten Forming Fabrics, Inc., Appleton, Wis., and designated as numbers 934, 937, 939 and 959 and Albany 94M manufactured by Albany International, Appleton Wire Division, Appleton, Wis.

In order to provide stretch to the tissue, a speed differential is provided between fabrics at one or more points of transfer of the wet web. The speed difference between the forming fabric and the transfer fabric can be from about 5 to about 75 percent or greater, preferably from about 10 to about 35 percent, and more preferably from about 15 to about 25 percent, based on the speed of the slower transfer fabric. The optimum speed differential will depend on a variety of factors, including the particular type of product being made. As previously mentioned, the increase in stretch imparted to the web is proportional to the speed differential. For a single-ply uncreped throughdried bath tissue having a basis weight of about 25 grams per square meter, for example, a speed differential of from about 20 to about 25 percent between the forming fabric and a sole transfer fabric produces a stretch in the final product of from about 15 to about 25 percent. The stretch can be imparted to the web using a single differential speed transfer or two or more differential speed transfers of the wet web prior to drying. Hence there can be one or more transfer fabrics. The amount of stretch imparted to the web can hence be divided among one, two, three or more differential speed transfers. The web is transferred to the last fabric (the through drying fabric) for final drying preferably with the assistance of vacuum to ensure macroscopic rearrangement of the web to give the desired bulk and appearance.

The use of separate transfer and through drying fabrics offers a significant improvement since it allows the two fabrics to be designed specifically to address key product requirements independently. For example, the transfer fabrics are generally optimized to allow efficient conversion of high rush transfer levels to high MD stretch and to improve sheet smoothness while through drying fabrics are designed to deliver bulk and CD stretch. It is, therefore, useful to have quite fine and relatively planar transfer fabrics and through drying fabrics which are quite coarse and three dimensional in the optimized configuration. The result is that a relatively smooth sheet leaves the transfer section and then is macroscopically rearranged (with vacuum assist) to give the high bulk, high CD stretch surface topology of the through drying fabric. No visible (at least not macroscopically visible) trace of the transfer fabric remains in the finished product. Sheet topology is completely changed from transfer to through drying fabric and fibers are macroscopically rearranged, including significant fiber-to-fiber movement.

The drying process can be any noncompressive drying method which tends to preserve the bulk or thickness of the wet web including, without limitation, through-air drying, infra-red radiation, microwave drying, etc. Because of its commercial availability and practicality, through-air drying is well-known and is a preferred means for noncompressively drying the web for purposes of this invention. Suitable through drying fabrics include, without limitation, Asten 920A and 937A and Velostar P800 and 103A. The web is preferably dried to final dryness on the through drying fabric, without being pressed against the surface of a Yankee dryer, and without subsequent creping. This provides a product of relatively uniform density as compared to products made by a process in which the web was pressed against a Yankee dryer while still wet and supported by the through drying fabric or by another fabric, or as compared to spot-bonded airlaid products. Although the final product appearance and bulk are dominated by the through drying fabric design, the machine direction stretch in the web is primarily provided by the transfer fabric, thus giving the method of this invention greater process flexibility.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A method of making a paper web comprising:

over drying the paper web by a dryer;

transporting the paper web to a reel; and supplying dry air above and below the paper web's travel path from the dryer to the reel, said dry air sufficient to prevent the paper web from reaching its moisture equilibrium point until after the paper web has been wound into a parent roll.

2. The method of claim 1 wherein the over drying comprises through-air drying.

3. The method of claim 2 comprising:

transferring the paper web from a through-air dryer fabric to at least one carrier fabric located between a through-air dryer and the reel by a vacuum transfer roll; and conveying the paper web on the at least one carrier fabric for at least a portion of the travel path from the through-air dryer to the reel.

4. The method of claim 3 comprising supplying dry air towards a vacuum zone of the vacuum transfer roll.

5. The method of claim 4 comprising supplying dry air adjacent to the paper web or the at least one carrier fabric between the vacuum transfer roll and the reel.

6. The method of claim 3 comprising supplying dry air adjacent to the paper web or the at least one carrier fabric between the vacuum transfer roll and the reel.

7. The method of claim 1 comprising over drying the paper web to a moisture content of about 5 percent or less at the exit of the dryer.

8. The method of claim 1 comprising over drying the paper web to a moisture content of about 3 percent or less at the exit of the dryer.

9. The method of claim 1 comprising over drying the paper web to a moisture content of about 2 percent or less at the exit of the dryer.

10. The method of claim 1 wherein the dry air has a relative humidity of about 20 percent or less.

11. The method of claim 1 comprising winding the paper web into a parent roll and then wrapping the parent roll in a moisture impermeable substrate after being wound.

12. The method of claim 11 comprising removing the moisture impermeable substrate and converting the parent roll into a finished product in a room having a relative humidity less than about 35 percent.

13. The method of claim 12 wherein the converting comprises calendaring the paper web.

14. The method of claim 11 comprising removing the moisture impermeable substrate, unwinding the parent roll, and supplying dry air adjacent at least a portion of the paper web's travel path during converting into a finished product.

15. A method of making a paper web comprising:

(a) over drying the paper web by a dryer;

(b) transporting the paper web to a reel;

(c) supplying dry air adjacent at least a portion of the paper web's travel path from the dryer to the reel;

(d) winding the paper web into a parent roll; and (e) wrapping the parent roll in a moisture impermeable substrate after being wound.

16. The method of claim 15 comprising removing the moisture impermeable substrate and converting the parent roll into a finished product in a room having a relative humidity less than about 35 percent.

17. The method of claim 16 wherein the converting comprises calendaring the paper web.

18. The method of claim 15 comprising removing the moisture impermeable substrate, unwinding the parent roll, and supplying dry air adjacent at least a portion of the paper web's travel path during converting into a finished product.

* * * * *